US008333381B2

(12) United States Patent
Francis

(10) Patent No.: US 8,333,381 B2
(45) Date of Patent: Dec. 18, 2012

(54) CONCAVE TIC-TAC-TOE GAME BOARD WITH DEFLECTOR FOR ROLLING GAME PLAYING MEMBER

(76) Inventor: Andi Francis, Powys (GB)

( * ) Notice: Subject to any disclaimer, the term of this patent is extended or adjusted under 35 U.S.C. 154(b) by 136 days.

(21) Appl. No.: 12/866,260

(22) PCT Filed: Feb. 3, 2009

(86) PCT No.: PCT/GB2009/050098

§ 371 (c)(1),
(2), (4) Date: Aug. 5, 2010

(87) PCT Pub. No.: WO2009/098503

PCT Pub. Date: Aug. 13, 2009

(65) Prior Publication Data

US 2011/0001287 A1 Jan. 6, 2011

(30) Foreign Application Priority Data

Feb. 5, 2008 (GB) ..... 0802054.7

(51) Int. Cl.
*A63F 7/00* (2006.01)

(52) U.S. Cl. ..... 273/271; 273/118 R; 273/123 R

(58) Field of Classification Search ..... 273/109, 273/113, 118, 123 R, 119 R, 120 R, 138.3, 273/142 E, 441, 264, 271, 287, 118 R
See application file for complete search history.

(56) References Cited

U.S. PATENT DOCUMENTS

| | | | | | |
|---|---|---|---|---|---|
| 725,118 | A * | 4/1903 | Mater | 273/123 R |
| 795,049 | A * | 7/1905 | Mueller | 273/399 |
| 1,314,623 | A * | 9/1919 | Wagner | 273/120 R |
| 1,850,045 | A * | 3/1932 | Achor | 273/115 |
| 2,753,187 | A * | 7/1956 | Orsini | 273/120 R |
| 2,788,974 | A * | 4/1957 | Pick | 273/115 |
| 3,236,522 | A * | 2/1966 | Brown | 273/110 |
| 3,295,852 | A * | 1/1967 | Dunn | 273/115 |
| 3,603,589 | A | 9/1971 | Sonntag | |
| 3,877,699 | A | 4/1975 | Reiner | |
| 3,947,034 | A * | 3/1976 | Waters | 273/123 R |
| 4,336,938 | A * | 6/1982 | Laroche | 273/120 R |
| 4,643,425 | A | 2/1987 | Herzenberger | |
| 4,984,796 | A * | 1/1991 | Peacock | 273/142 E |
| 5,755,440 | A | 5/1998 | Sher | |
| 5,775,697 | A * | 7/1998 | Snarli | 273/274 |
| 5,941,524 | A * | 8/1999 | Chang | 273/123 R |
| 8,028,994 | B2 * | 10/2011 | Pececnik | 273/269 |
| 2002/0125636 | A1 * | 9/2002 | Lundberg | 273/241 |

FOREIGN PATENT DOCUMENTS

WO WO 8400114 A 1/1984

* cited by examiner

*Primary Examiner* — William Pierce
(74) *Attorney, Agent, or Firm* — Gordon & Jacobson, PC

(57) ABSTRACT

A game board is disclosed for playing tic-tac-toe. The game board comprises a substantially concave playing surface, having a plurality of depressions at a lower region thereof. In use, the game playing members are launched onto the playing surface and spiral down the concave surface before locating within one of the depressions.

11 Claims, 7 Drawing Sheets

CONCAVE TIC-TAC-TOE GAME BOARD WITH DEFLECTOR FOR ROLLING GAME PLAYING MEMBER

BACKGROUND OF THE INVENTION

1. Field of the Invention

The present invention relates to a game board and particularly, but not exclusively, to a game board for playing tic-tac-toe.

2. State of the Art

Tic-tac-toe, also known as noughts-and-crosses and hugs-and-kisses, is a game traditionally played on paper between two players, wherein one player aims to place three X's in a straight line on a 3×3 grid while the other player attempts to place three O's in a straight line on the same grid.

Variations to the game comprise the use of a game board wherein the board comprises a pre-printed 3×3 grid onto which the players place white and black chequers, for example, as apposed to writing O's and X's. Alternatively, the board may comprise a series of depressions arranged in a 3×3 grid format for holding black and white marbles, for example.

U.S. Pat. No. 3,877,699 discloses a game board for playing poker or bingo and even tic-tac-toe. The board comprises a substantially planar surface with a series of 25 depressions formed therein, arranged to a substantially square 5×5 grid. The board further comprises an impact transfer device for launching marbles, or similar, onto of the board. The board comprises a peripherally extending trough for capturing the marbles if they pass over the edge of the playing surface. However, it has been found that the trough only captures slowly moving marbles; quickly moving marbles are found to simply pass over the trough and are thus easily lost.

SUMMARY OF THE INVENTION

I have now devised a game board for playing tic-tac-toe which alleviates the above-mentioned problem.

In accordance with the present invention as seen from a first aspect, there is provided a game board for playing tic-tac-toe, the game board comprising a substantially concave playing surface, the playing surface comprising a plurality of depressions at a lower region thereof for locating at least one game playing member.

Preferably, the plurality of depressions are arranged to a substantially square grid comprising rows and columns. The playing surface preferably comprises nine depressions arranged in three rows and three columns.

Preferably, the game board further comprises holding means arranged substantially around the periphery of the playing surface for holding the at least one game playing member. Alternatively, the holding means may be positioned substantially underneath the playing surface.

The game board preferably further comprises a base section which may be mounted to the underside of the playing surface via extendable means, such that the playing surface can be raised or lowered with respect to the base section. The playing surface preferably further comprises side walls which extend substantially downwardly from the periphery of the playing surface, such that when the game board is not in use, the members may be placed on the base section and the playing surface can be lowered until the side walls abut the base section to house the members therein.

The playing surface preferably further comprises at least two further depressions arranged substantially opposite each other, near to the periphery of the playing surface.

Preferably, the game board further comprises means for launching the at least one game playing member around the playing surface. The launching means preferably launches the at least one game playing member along a substantially circular trajectory such that the at least one game playing member spirals around the playing surface before passing onto the depressions arranged at the lower region of the playing surface.

Preferably, the launching means is movably mounted along the periphery of the upper edge of the playing surface so that it can be repositioned substantially opposite a player.

The game board preferably further comprises at least one deflector for deflecting the at least one game playing member from a substantially circular trajectory onto the plurality of depressions arranged at the lower region of the playing surface. Preferably, the at least one deflector is slidably mounted to the periphery of the playing surface and can rotate between a first position in which the deflector extends onto the playing surface and a second position in which the deflector does not extend onto the playing surface.

Preferably, the at least one game playing member comprises a substantially spherical member, such as a marble.

Preferably, the playing surface is covered with a material such as velvet.

Embodiments of the present invention will now be described by way of example only and with reference to the accompanying drawings.

DETAILED DESCRIPTION OF THE PREFERRED EMBODIMENTS

Figure 1:
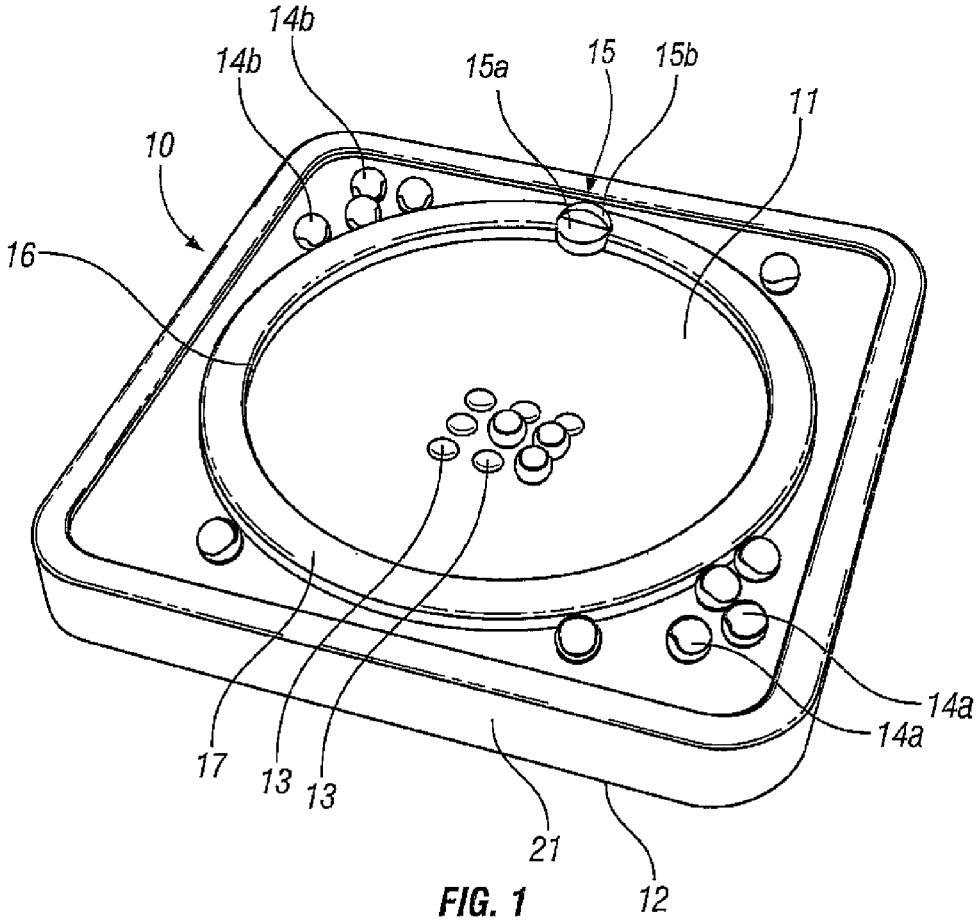
FIG. 1 is a perspective view of the game board in accordance with the present invention.
Figure 2:
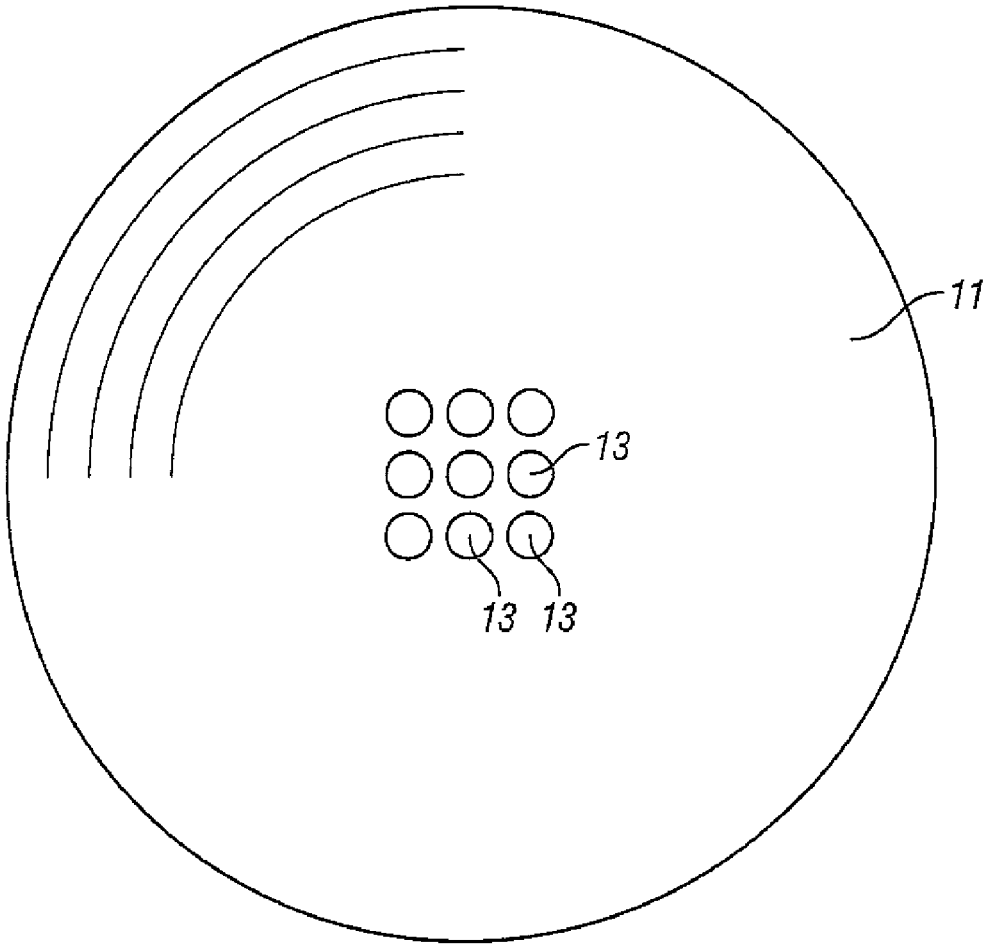
FIG. 2 is a plan view of the depressions arranged at the lower regions of the playing surface illustrated in FIG. 1.

Referring to the drawings and initially FIGS. 1 to 3, there is shown a game board 10 for playing tic-tac-toe, in accordance with the present invention. The board comprises a substantially circular, concave playing surface 11, which may be covered with a velvet material, for example, and which is mounted to a base section 12. The playing surface comprises nine substantially concave depressions 13 formed at the lower region of the playing surface 11 for locating the playing pieces, which comprise marbles 14 or similar that are rolled or launched onto the surface. The depressions 13 are arranged to a substantially square grid comprising three rows and three columns as shown in FIG. 2, as is typical for playing the game of tic-tac-toe.

The game board 10 is preferably further provided with a deflector 15 which is slidably mounted to the periphery 16 of the playing surface 11, such that it can move around the playing surface 11 to reside substantially opposite a player. The deflector 15 is formed as part of a rim 17 which extends around the periphery 16 of the playing surface 11. The deflector 15 is substantially L-shaped and comprises a first arm 15*a* and a second arm 15*b*, arranged substantially perpendicularly to each other.

Figure 3A:
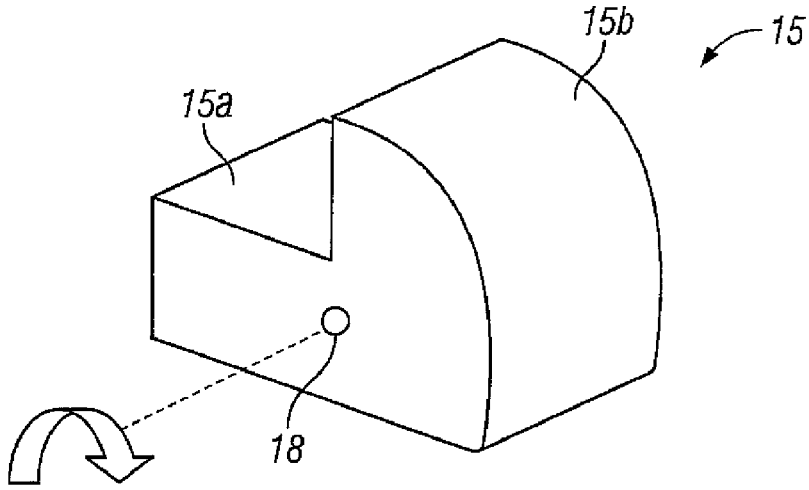
FIG. 3*a* is a magnified view of the deflector illustrated in FIG. 1.
Figure 3B:
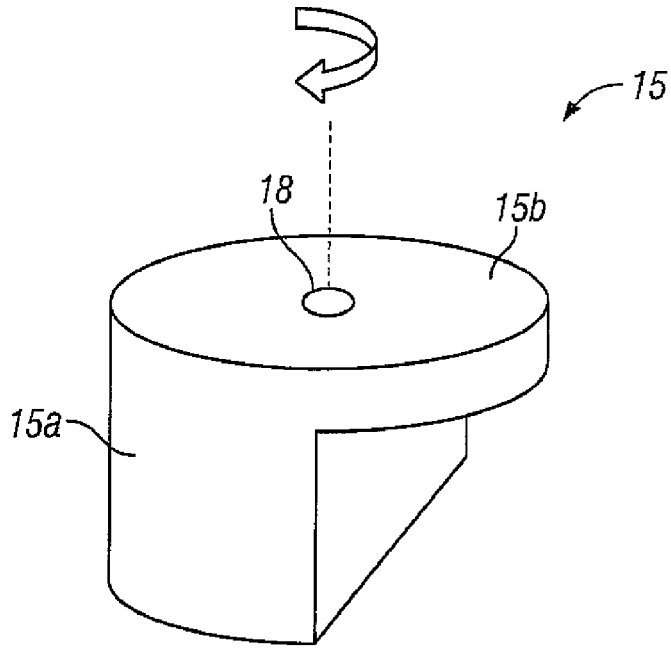
FIG. 3*b* is a magnified view of an alternative embodiment of the deflector illustrated in FIG. 1.

At the intersection of the two arms 15*a*, 15*b* as shown in FIG. 3*a* there is provided a pivot 18 so that the deflector 15 can rotate between a first and second position. In the first position, the first arm 15*a* of the deflector 15 extends onto the playing surface 11 while the second arm 15*b* extends substantially upwardly away from the surface. To move the deflector 15 from the first position to the second position, the second arm 15*b* is pivoted away from the playing surface 11 so as to lift the first arm 15*a* off the playing surface 11. When the second arm 15*b* has been fully rotated, the underside of the first arm 15*a* provides a surface which extends substantially flush with the inner surface of the rim 17. In an alternative configuration as shown in FIG. 3*b*, the deflector 15 may be arranged to rotate about the first arm 15*a* so as to rotate the first arm 15*a* in and out of the playing area 11.

Figure 4:
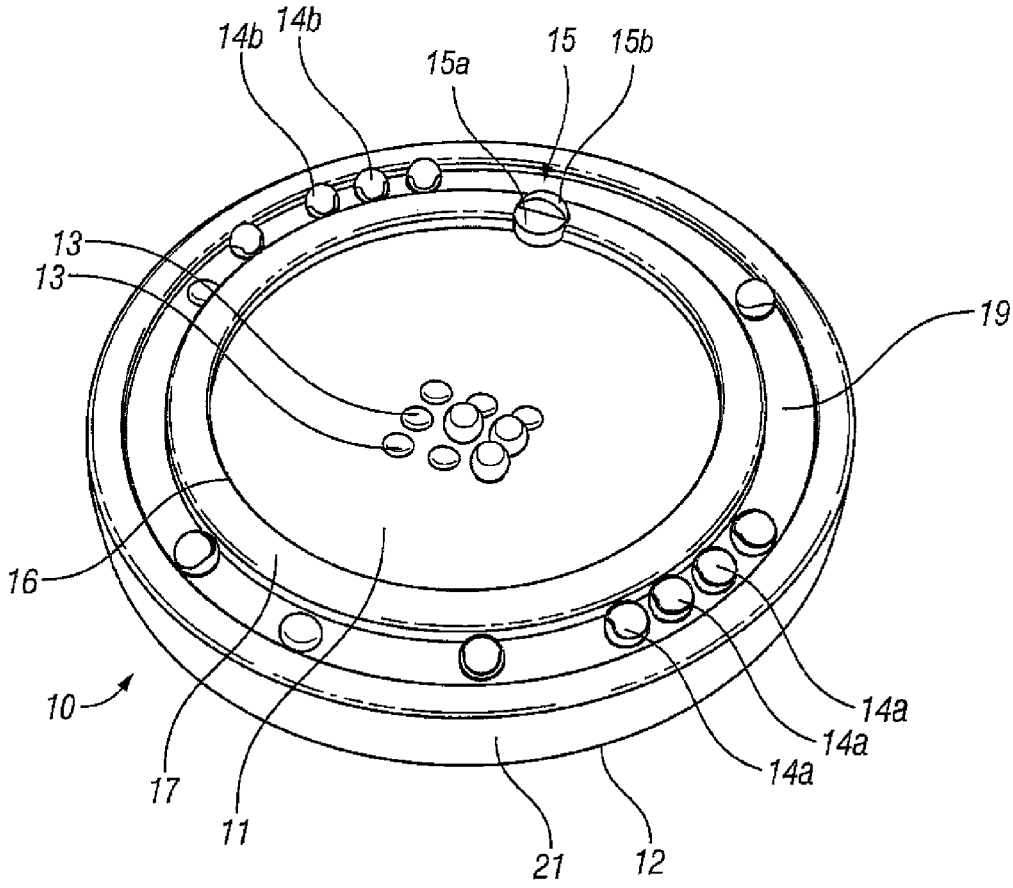
FIG. 4 is a perspective view of the game board in accordance with a first embodiment of the present invention.

In accordance with a first embodiment of the present invention as shown in FIG. 4 the board 10 further comprises a channel 19 that extends substantially around the periphery 16 of the playing surface 11, and which is used for holding the playing pieces 14 when not in use. The channel 19 may be compartmentalised to differentiate between player playing pieces 14*a*, 14*b*, between scoring and non-scoring pieces, or between "live" and "dead" playing pieces etc.

Figure 5:
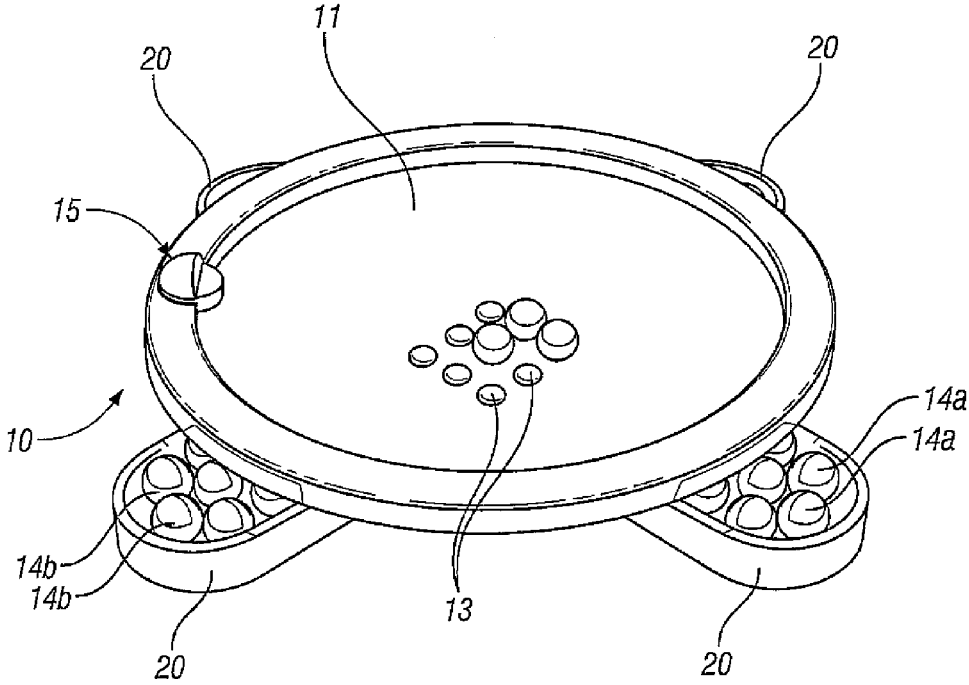
FIG. 5 is a perspective view of the game board in accordance with a second embodiment of the present invention.

In accordance with a second embodiment of the present invention as shown in FIG. 5 the board comprises a series of pockets 20 for holding the playing pieces, arranged around the periphery of the playing surface 11.

Figure 6:
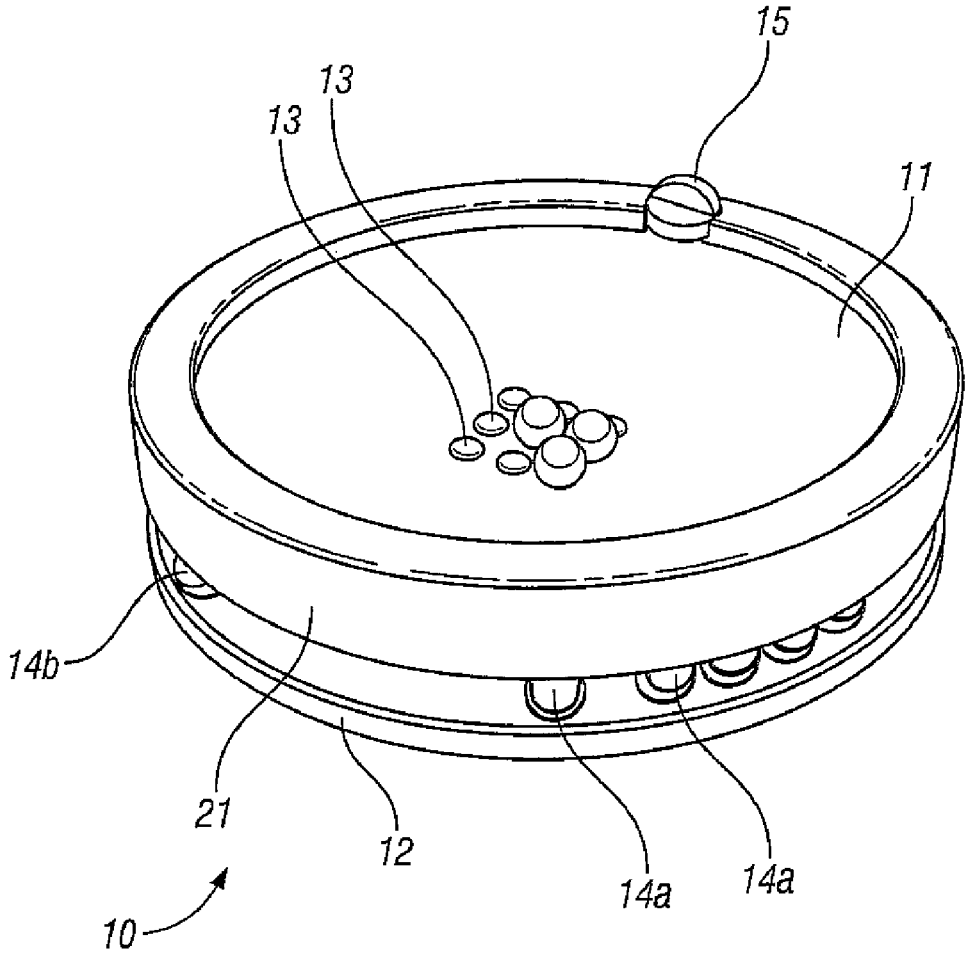
FIG. 6 is a perspective view of the game board in accordance with a third embodiment of the present invention; and, FIG. 7 is a perspective view of the game board in accordance with the second embodiment of the present invention with a cover in place.

In accordance with a third embodiment of the present invention as shown in FIG. 6 the separation of the playing surface 11 from the base may be extended or retracted so as to enable the playing surface 11 to be raised or lowered with respect to the base 12. In addition, the playing surface 11 further comprises side walls 21 which extend downwardly from the periphery 16 of the playing surface 11, such that when the playing surface 11 has been fully retracted onto the base 12, the side walls 21 abut the base 12 substantially along the periphery thereof, to create a storage compartment for the playing pieces 14 situated between the underside of the playing surface 11 and the upper surface of the base 12.

Figure 7:
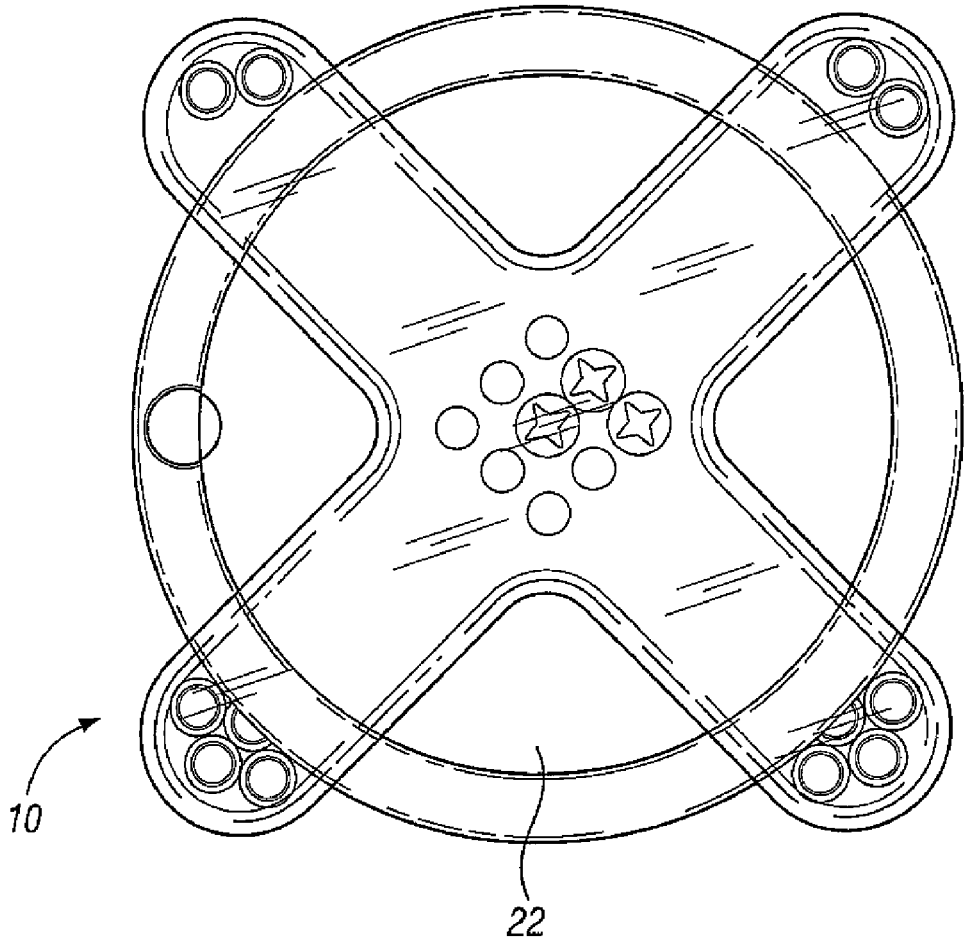

It is further preferred that the board 10 comprises a cover 22, substantially in the form of an intersecting O and X, as shown in FIG. 7, for covering the board 10 to help prevent any dust and dirt from settling onto the playing surface. The playing surface of each embodiment preferably further comprises a pair of substantially concave depressions (not shown) arranged substantially opposite each other at a position near the periphery of the playing surface.

In use, a player places a marble 14 or similar within one of the depressions (not shown) arranged near the periphery 16 of the playing surface 11 and "flicks" the marble 14 in a direction which causes the marble 14 to move around the playing surface 11. Alternatively, a player may simply roll a marble 14 onto the playing surface 11. As the rules of the game so permit, the deflector 15 may be rotated onto the playing surface 11 so as to deflect the marble 14 onto the depressions 13 arranged at the lower region of the playing surface 11 in an attempt to locate the marble 14 within a particular depression. Alternatively, the marble 14 may be allowed to simply spiral downwardly toward the depressions 13 and come to rest in a vacant depression 13.

In yet a further embodiment the game board 10 may comprise launching means (not shown) for example, a spring biased arm. The arm (not shown) may be pivoted against the bias of the spring and then released to impact the marble 14 or similar and thus launch the marble 14 onto the playing surface 11 and in a direction which causes the marble 14 to spiral downwardly onto the depressions 13 arranged at the lower region of the playing surface 11. In this manner, the concave form of the playing surface 11 causes the marble 14 to collect at the depressions 13 at the lower region of the playing surface 11 and thus prevents the marbles 14 from rolling off the playing surface 11.

From the foregoing therefore, it is evident that game board of the present invention provides for a more compact and convenient way of playing tic-tac-toe.

The invention claimed is:

1. A game board for playing tic-tac-toe, comprising:

a substantially concave playing surface, the playing surface defining nine depressions arranged in three rows and three columns at a lower region thereof for separately locating a game playing member; and at least one deflector for deflecting a game playing member from a substantially circular trajectory onto the nine depressions arranged at the lower region of the playing surface, wherein the at least one deflector is slidably mounted to a periphery of the playing surface.

2. A game board according to claim 1, wherein:

the nine depressions are arranged in a substantially square grid comprising the three rows and three columns.

3. A game board according to claim 1, further comprising:

a channel arranged substantially around the periphery of the playing surface, the channel for holding the game playing member.

4. A game board according to claim 1, further comprising:

a storage compartment positioned substantially underneath the playing surface, the storage compartment for holding the game playing member.

5. A game board according to claim 1, further comprising:

a base section which couples to an underside of the playing surface such that the playing surface can be raised or lowered with respect to the base section.

6. A game board according to claim 5, further comprising:

side walls which extend substantially downwardly from a periphery of the playing surface such that when the game board is not in use, the members may be placed on the base section and the playing surface can be lowered until the side walls abut the base section to house the members between the playing surface and the base section.

7. A game board according to claim 1, further comprising:

at least two additional depressions arranged substantially opposite each other at or adjacent the periphery of the playing surface.

8. A game board according to claim 1, further comprising:

means for launching the at least one game playing member around the playing surface.

9. A game board according to claim 8, wherein:

the means for launching is adapted to launch the game playing member along a substantially circular trajectory such that the game playing member spirals around the playing surface before passing onto the nine depressions arranged at the lower region of the playing surface.

10. A game board according to claim 9, wherein:

the means for launching is movably mounted along the periphery of an upper edge of the playing surface such that the means for launching is configurable to a position substantially opposite a player.

11. A game board according to claim 1, wherein:

said at least one deflector is rotatable between a first position in which the slidably mounted deflector extends onto the playing surface and a second position in which the slidably mounted deflector does not extend onto the playing surface.

* * * * *